US009510087B2

(12) United States Patent
Cai et al.

(10) Patent No.: US 9,510,087 B2
(45) Date of Patent: Nov. 29, 2016

(54) ACOUSTIC DEVICE

(71) Applicants: Bin Cai, Shenzhen (CN); Yunxia Xu, Shenzhen (CN)

(72) Inventors: Bin Cai, Shenzhen (CN); Yunxia Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/986,002

(22) Filed: Dec. 31, 2015

(65) Prior Publication Data

US 2016/0227314 A1 Aug. 4, 2016

(30) Foreign Application Priority Data

Feb. 2, 2015 (CN) ..... 2015 2 0071384 U

(51) Int. Cl.

| | |
|---|---|
| ***H04R 1/28*** | (2006.01) |
| ***H04R 7/14*** | (2006.01) |
| ***H04R 9/06*** | (2006.01) |
| ***H04R 1/02*** | (2006.01) |

(52) U.S. Cl.

CPC ..... *H04R 1/2888* (2013.01); *H04R 1/021* (2013.01); *H04R 1/025* (2013.01); *H04R 7/14* (2013.01); *H04R 9/06* (2013.01)

(58) Field of Classification Search

CPC .... H04R 1/021; H04R 1/025; H04R 1/2888; H04R 7/14; H04R 9/06; H04R 2201/029

See application file for complete search history.

(56) References Cited

U.S. PATENT DOCUMENTS

| | | | | |
|---|---|---|---|---|
| 1,990,409 | A * | 2/1935 | Lawrence | H04R 7/06 181/164 |
| 4,434,203 | A * | 2/1984 | Briefer | G01L 9/0044 181/157 |
| 7,881,490 | B2 * | 2/2011 | Chiba | H04R 9/022 381/396 |
| 7,946,378 | B2 * | 5/2011 | Windischberger | H04R 7/20 181/157 |
| 2007/0209866 | A1 * | 9/2007 | Frasl | H04R 7/14 181/157 |
| 2012/0275637 | A1 * | 11/2012 | Liao | H04R 1/025 381/395 |
| 2014/0294225 | A1 * | 10/2014 | Ji | H04R 1/021 381/386 |
| 2014/0301587 | A1 * | 10/2014 | Ji | H04R 1/025 381/332 |
| 2016/0295316 | A1 * | 10/2016 | Shao | H04R 1/021 |

FOREIGN PATENT DOCUMENTS

JP 01269396 A * 10/1989

* cited by examiner

*Primary Examiner* — Matthew Eason
(74) *Attorney, Agent, or Firm* — Na Xu; IPro, PLLC

(57) ABSTRACT

One embodiment of the invention discloses an acoustic device having a housing having an accommodating space with a sound hole formed thereon and communicating with the accommodating space; a speaker unit received in the accommodating space having a diaphragm including a first area away from the sound hole and a second area close to the through window; wherein, the diaphragm has a plurality of corrugations formed on the first area and the second area, respectively, and the amount of the corrugations on the first area is less than that on the second area.

12 Claims, 3 Drawing Sheets

ACOUSTIC DEVICE

FIELD OF THE INVENTION

One embodiment of the invention is related to an acoustic device, and more particularly to a speaker box with high audio performance.

DESCRIPTION OF RELATED ART

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous.

In a typical acoustic device, such as a speaker or a speaker box, a sound radiation surface is provided for generating sound. Generally, the sound radiation surface is a membrane or a diaphragm which is activated by an electrified voice coil. While activated, the sound radiation surface vibrates and produces audible sounds. Recently, the speaker box often defines a sound hole on the sidewall of the speaker box. When operates the speaker box and the voice coil vibrates, a sound resistance in an area close to the sound hole is less than that in an area away from the sound hole. Thus, an unbalance vibration occurred while the voice coil vibrating, which results in a distortion of the sound generated from the speaker box, and some other defaults in the speaker box.

Therefore, an improved acoustic device is provided in the embodiment of the present disclosure to solve the problem mentioned above.

Figure 1:
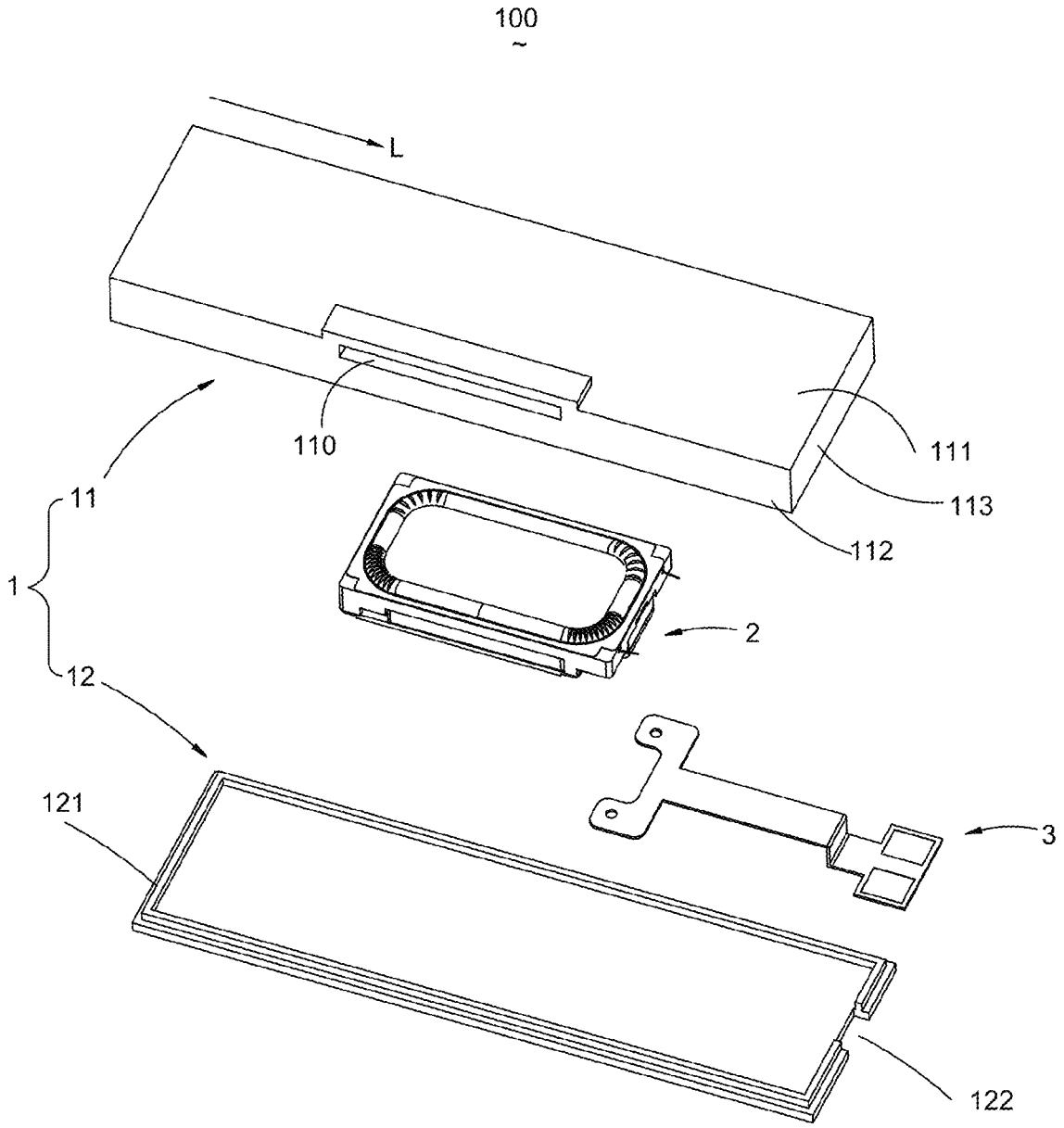
FIG. 1 is an exploded isometric view of an acoustic device related to the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe an exemplary embodiment of the present invention in detail. In this section we shall explain several exemplary embodiments of this invention with reference to the appended drawings. Whenever the shapes, relative positions and other aspects of the parts described in the embodiment are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 2:
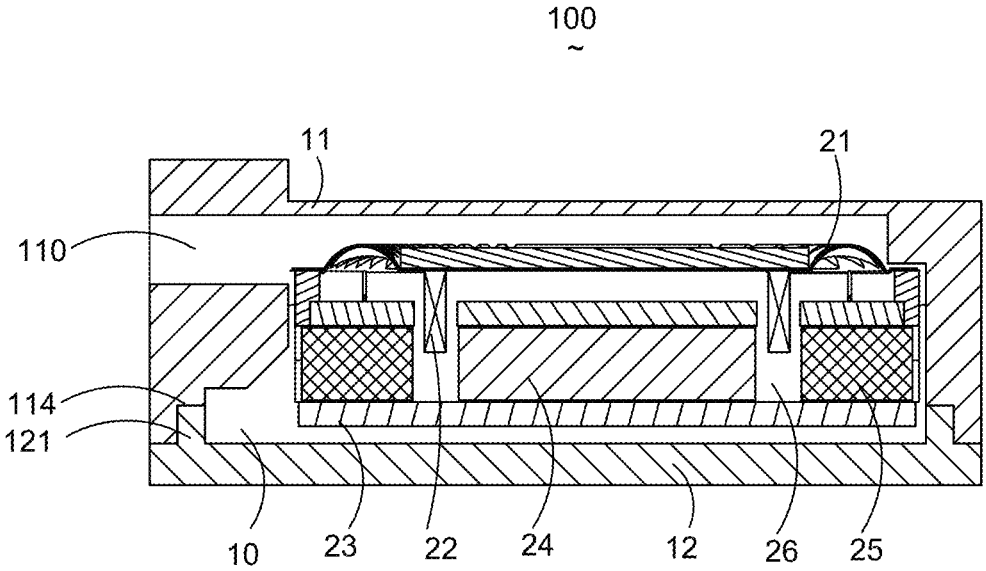
FIG. 2 is a cross-sectional view of the acoustic device in FIG. 1.

Referring to FIG. 1 and FIG. 2, an acoustic device 100 according to an exemplary embodiment includes a housing 1 having a cover 11 and a mounting plate 12 assembled with the cover 11 for forming a receiving space 10, a speaker unit 2 received in the receiving space 10 and an electric terminal 3 electrically connected with the speaker unit 2 and extends out of the receiving space 10 for connecting to outer circuit.

The cover 11 has a rectangular box shape, and includes a rectangular top wall 111 defining a length direction L, a pair of first sidewalls 112 extending substantially perpendicular to the top wall 111 in the length direction L and a pair of second sidewalls 113 extending substantially perpendicular to the top wall 111 in a direction perpendicular to the length direction L. A through window 110 for transmitting sound generated by the speaker unit 2 to outside is formed in one of the first sidewalls 112 or one of the second sidewalls 113. The through window 110 has a slit shape and communicates with the receiving space 10. In this embodiment, the through window 110 is formed in the first sidewall 112 in the length direction L. The first sidewalls 112 and second sidewalls 113 are provided with depressions 114 that are recessed in a direction toward the top wall 111.

The mounting plate 12 has a rectangular shape with a dimension substantially equal to the top wall 111. The mounting plate 12 has a ring shaped projection 121 protruding toward the top wall 111 of the cover 11 for accommodating into the depressions 114 to assemble with the cover 11. The mounting plate 12 further defines a cut-out portion 122 in one side thereof, via which the electronic terminal 3 leads out of the cover 11.

The speaker unit 2 includes a vibration unit, a magnetic circuit unit and a frame 4 for containing the magnetic circuit unit. The vibration unit comprises a diaphragm 21 and a voice coil 22 connected with the diaphragm 21 for driving the diaphragm 21 to vibrate. Optionally, the voice coil 22 may be connected to the diaphragm 21 via a medium which is directly connected with the diaphragm 21. In other words, the voice coil 22 may be connected to the diaphragm 21 directly or indirectly. Therefore, the term "connect" here means to connect something to another via a medium or to connect something to another directly without any medium.

The magnetic circuit unit comprises a base board 23, a first magnetic conduction member 24 disposed on a center portion of the base board 23, a second magnetic conduction member 25 disposed on a periphery portion of the base board 23 for forming a magnetic gap 26 together with the first magnetic conduction member 24. The base board 23 is made of magnetic conduction materials for effectively conducting magnetic fluxes. At least one of the first and second magnetic conduction members 24, 25 is a permanent magnet. In this embodiment, both the first and second magnetic conduction members 24, 25 are permanent magnets. In an alternative embodiment, the first magnetic conduction member is a permanent magnet and the second magnetic conduction member is made of magnetic conduction materials for effectively conducting magnetic fluxes. Furthermore, the second magnetic conduction member and the base board are formed an integral unit. On the contrary, the first magnetic conduction member is made of magnetic conduction materials for effectively conducting magnetic fluxes and the second magnetic conduction member is a permanent magnet. The first magnetic conduction member and the base board are formed an integral unit.

Figure 3:
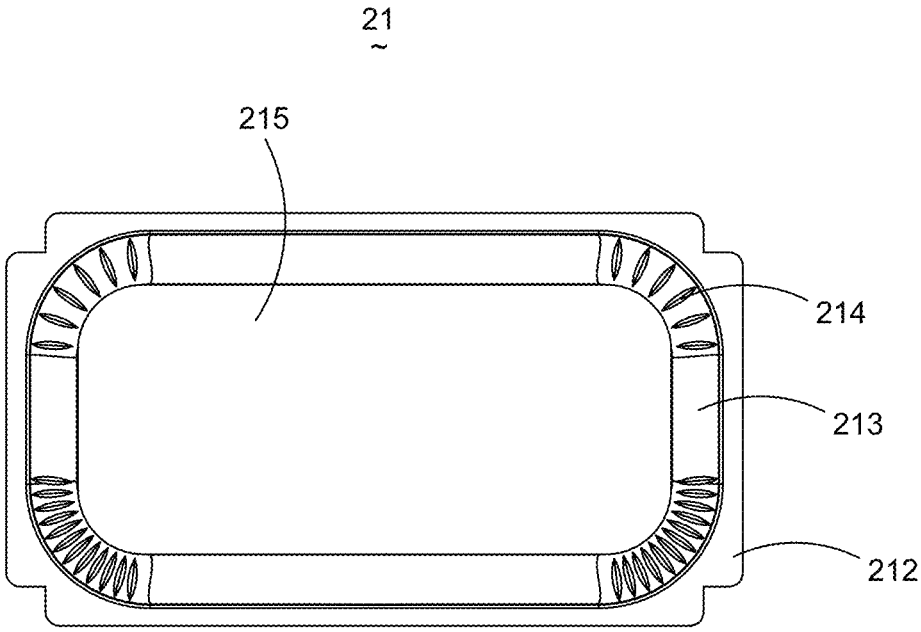
FIG. 3 is an illustrative isometric view of a diaphragm of the acoustic device in FIG. 1
Figure 4:
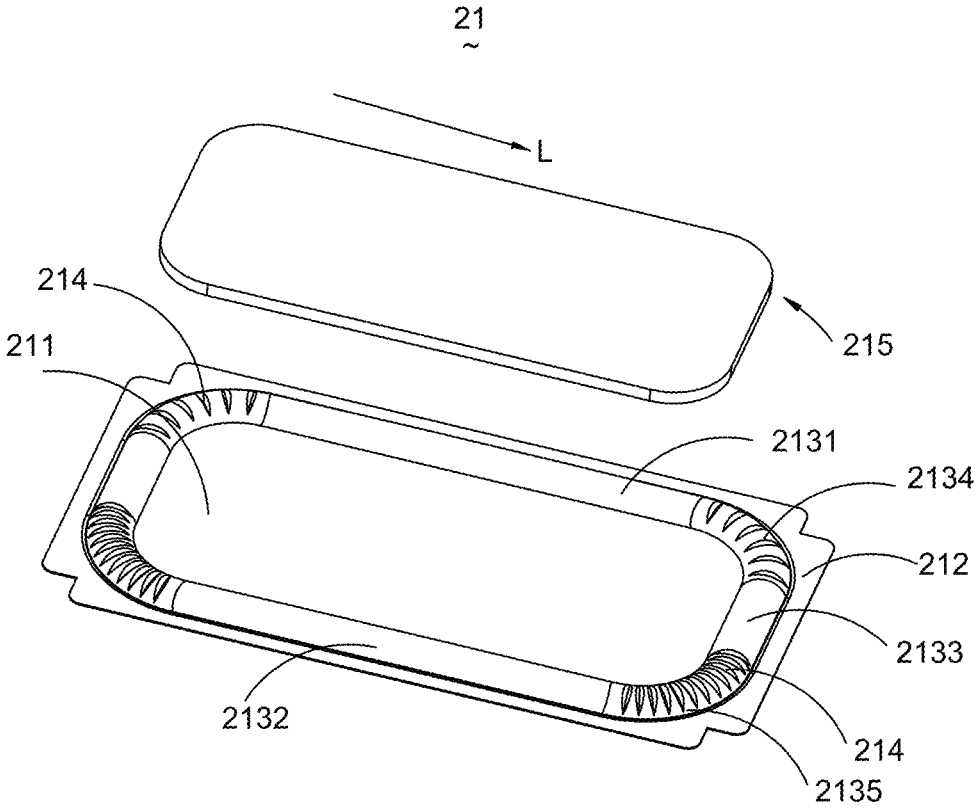
FIG. 4 is an exploded isometric view of the diaphragm in FIG. 3.

As shown in FIGS. 2-4, the diaphragm 21 has a rectangular shape, is parallel to the top wall 111 of the cover 11. The diaphragm 21 includes a central portion 211, an edge portion 212 for fixing on the frame 4 and a connecting portion 213 connected between the central portion 211 and the edge portion 212. The connecting portion 213 has a convex shape and protrudes toward the top wall 111 of the cover 11. Alternatively, the connecting portion 213 may have a concave shape and protrudes away from the top wall 111 of the cover 11.

The connecting portion 213 includes a first length straight segment 2131 extending parallel to the length direction L and disposed away from the through window 110, a second length straight segment 2132 opposite to the first length segments 2131, a pair of short straight segments 2133 extending perpendicular to the length direction, disposed between the length straight segments 2131,2132 and spaced from each other, a pair of first arc segments 2134 connecting the first length straight segment 2131 to ends of the short straight segments 2133 adjacent to the first length straight segment 2131 respectively, and a pair of second arc segments 2135 connecting the second length straight segment 2132 to the other ends of the short straight segments 2133 adjacent to the second length straight segment 2132 respectively, i.e. the first and second arc segments 2134, 2135 are disposed at four corners of the connecting portion 213, respectively.

The diaphragm 21 further comprises a plurality of corrugations 214 formed on the connecting portion 2123. Specifically, the corrugations 214 are formed on the first and second arc segments 2134, 2135, respectively. In this embodiment, the amount of corrugations 214 on the first arc segment 2134 is less than that on the second arc segment 2135. With such arrangement of the corrugation, rigidity of an area of the diaphragm close to the through window is higher than that of an area of the diaphragm away from the through window. Thus, the unbalance vibration in the speaker box can be avoided. The amount of the corrugations can be variable according to actual requirement.

The diaphragm 21 further comprises a strength member 215 attached on an upper surface of the central portion 211. The strength member 215 and the central portion 211 may be integrally formed as one unit. Alternatively, the strength member 215 and the central portion 211 may be separated part, which are connected with each other by normal means, such as gluing, adhesive, and so on. With such configuration of the strength member, the central portion can be reinforced and the deformation of the diaphragm can be avoided.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. An acoustic device, comprising:

a cover having a top wall and a plurality of sidewalls connected with the top wall;

a mounting plate assembled with the cover for forming a receiving space;

a speaker unit received in the receiving space, wherein, the cover further defines a through window formed in one of the sidewalls for transmitting sound generated by the speaker unit to outside;

the speaker unit has a diaphragm including a first area away from the through window and a second area close to the through window;

the diaphragm has a plurality of corrugations formed on the first area and the second area, respectively, and the amount of the corrugations on the first area is less than that on the second area.

2. The acoustic device of claim 1, wherein, the cover has a rectangular box shape and defines a length direction;

the through window is formed in the sidewall in the length direction and has a slit shape.

3. The acoustic device of claim 2, wherein, the diaphragm comprises a central portion, an edge portion and a connecting portion on which the corrugations are formed connected between the central portion and the edge portion.

4. The acoustic device of claim 3, wherein, the connecting portion includes a first length straight segment away extending in the length direction and disposed away from the through window, a second length straight segment opposite to the first length straight segment, a pair of short straight segments extending in a direction perpendicular to the length direction, disposed between the first and second length straight segments and spaced from each other, a pair of first arc segments connecting ends of the short straight segments to the first length straight segment and a pair of second arc segments connecting the other ends of the short straight segments to the second length straight segment; the corrugations are formed on the first and second arc segments, respectively.

5. The acoustic device of claim 4, wherein, the amount of the corrugations on each of the first arc segments is less than that on each of the second arc segments.

6. The acoustic device of claim 3, wherein, the connecting portion has a convex shape and protrudes toward the top wall of the cover.

7. An acoustic device, comprising, a housing having an accommodating space with a sound hole formed therein and communicating with the accommodating space;

a speaker unit received in the accommodating space having a diaphragm including a first area away from the sound hole and a second area close to the sound hole; wherein, the diaphragm has a plurality of corrugations formed on the first area and the second area, respectively, and the amount of the corrugations on the second area is higher than that on the first area.

8. The acoustic device of claim 7, wherein, the housing has a rectangular box shape and defines a length direction;

the sound hole is formed in a sidewall of the housing in the length direction and presents in a form of a slit shape.

9. The acoustic device of claim 8, wherein, the diaphragm comprises a central portion, an edge portion and a connecting portion on which the corrugations are formed connected between the central portion and the edge portion.

10. The acoustic device of claim 9, wherein, the connecting portion includes a first length straight segment away extending in the length direction and disposed away from the sound hole, a second length straight segment opposite to the first length straight segment, a pair of short straight segments extending in a direction perpendicular to the length direction, disposed between the first and second length straight segments and spaced from each other, a pair of first arc segments connecting ends of the short straight segments to the first length straight segment and a pair of second arc segments connecting the other ends of the short straight segments to the second length straight segment; the corrugations are formed on the first and second arc segments, respectively.

11. The acoustic device of claim 10, wherein, the amount of the corrugations on each of the first arc segments is less than that on each of the second arc segments.

12. The acoustic device of claim 9, wherein, the connecting portion has a convex shape and protrudes toward the housing.

* * * * *